US005566390A

United States Patent [19]

Clancy

[11] Patent Number: 5,566,390

[45] Date of Patent: Oct. 22, 1996

[54] HAND SHIELD

[76] Inventor: Isobel E. Clancy, 8211 Osler Street, Vancouver, BC, Canada, V6P 4E3

[21] Appl. No.: 489,357

[22] Filed: Jun. 12, 1995

[51] Int. Cl.[6] ..... A41D 13/08

[52] U.S. Cl. ..... 2/16; 2/910; 2/162; 2/20

[58] Field of Search ..... 2/20, 21, 910, 2/162, 161.1, 161.4, 16

[56] References Cited

U.S. PATENT DOCUMENTS

| | | | |
|---|---|---|---|
| 894,311 | 7/1908 | Brenton | 2/20 X |
| 1,217,681 | 2/1917 | Baldridge | 2/20 X |
| 1,225,588 | 5/1917 | Curtiss | 2/20 |
| 1,631,128 | 6/1927 | Hinze | 2/20 |
| 4,295,229 | 10/1981 | Clark et al. | 2/20 |
| 4,411,024 | 10/1983 | Hayes | 2/910 X |
| 4,894,866 | 1/1990 | Walker | 2/910 X |

FOREIGN PATENT DOCUMENTS

| | | | |
|---|---|---|---|
| 3776 | of 1904 | United Kingdom | 2/20 |
| 356929 | 9/1931 | United Kingdom | 2/20 |

*Primary Examiner*—Paul C. Lewis

[57] ABSTRACT

A shield for protecting a back of a human hand. The inventive device includes a cover web sized to extend over and beyond the back and digits of a human hand. A plurality of finger loops extend from a lower surface of the cover web for engaging the fingers of the hand to couple the device thereto. A plurality of slits can extend through the web to permit individual articulation of the digits of the hand, and a wrist strap can be provided for securing an inner portion of the cover web relative to the hand.

1 Claim, 4 Drawing Sheets

32
34
36
38
40
28
42
44
48
50
52
54
30
46
18
20
22
24
14
12
16

32

34
36

HAND SHIELD

BACKGROUND OF THE INVENTION

1. Field of the Invention

The present invention relates to body covering structures and more particularly pertains to a hand shield for protecting a back of a human hand from receiving impinging sunlight.

2. Description of the Prior Art

The use of body covering structures is known in the prior art. More specifically, body covering structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art body covering structures include U.S. Pat. Nos. 4,785,478; 5,125,115; 4,809,366; 4,907,297; 4,051,553; and 5,295,269.

While these devices fulfill their respective, particular objectives and requirements, the aforementioned patents do not disclose a hand shield for protecting a back of a human hand which includes a cover web sized to extend over and beyond the back and digits of a human hand, and a plurality of finger loops extending from a lower surface of the cover web for engaging the fingers of the hand to couple the device thereto, wherein a plurality of slits extend through the web to permit individual articulation of the digits of the hand, and a wrist strap is provided for securing an inner portion of the cover web relative to the hand.

In these respects, the hand shield according to the present invention substantially departs from the conventional concepts and designs of the prior art, and in so doing provides an apparatus primarily developed for the purpose of protecting a back of a human hand.

SUMMARY OF THE INVENTION

In view of the foregoing disadvantages inherent in the known types of body covering structures now present in the prior art, the present invention provides a new hand shield construction wherein the same can be utilized for protecting a back of a human hand. As such, the general purpose of the present invention, which will be described subsequently in greater detail, is to provide a new hand shield apparatus and method which has many of the advantages of the body covering structures mentioned heretofore and many novel features that result in a hand shield which is not anticipated, rendered obvious, suggested, or even implied by any of the prior art body covering structures, either alone or in any combination thereof.

To attain this, the present invention generally comprises a shield for protecting a back of a human hand. The inventive device includes a cover web sized to extend over and beyond the back and digits of a human hand. A plurality of finger loops extend from a lower surface of the cover web for engaging the fingers of the hand to couple the device thereto. A plurality of slits can extend through the web to permit individual articulation of the digits of the hand, and a wrist strap can be provided for securing an inner portion of the cover web relative to the hand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hand shield apparatus and method which has many of the advantages of the body covering structures mentioned heretofore and many novel features that result in a hand shield which is not anticipated, rendered obvious, suggested, or even implied by any of the prior art tool guides, either alone or in any combination thereof.

It is another object of the present invention to provide a new hand shield which may be easily and efficiently manufactured and marketed.

It is a further object of the present invention to provide a new hand shield which is of a durable and reliable construction.

An even further object of the present invention is to provide a new hand shield which is susceptible of a low cost of manufacture with regard to both materials and labor, and which accordingly is then susceptible of low prices of sale to the consuming public, thereby making such hand shields economically available to the buying public.

Still yet another object of the present invention is to provide a new hand shield which provides in the apparatuses and methods of the prior art some of the advantages thereof, while simultaneously overcoming some of the disadvantages normally associated therewith.

Still another object of the present invention is to provide a new hand shield for protecting a back of a human hand from receiving sunlight directed thereonto.

Yet another object of the present invention is to provide a new hand shield which includes a cover web sized to extend over and beyond the back and digits of a human hand, and a plurality of finger loops extending from a lower surface of the cover web for engaging the fingers of the hand to couple the device thereto, wherein a plurality of slits extend through the web to permit individual articulation of the digits of the hand and a wrist strap is provided for securing an inner portion of the cover web relative to the hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
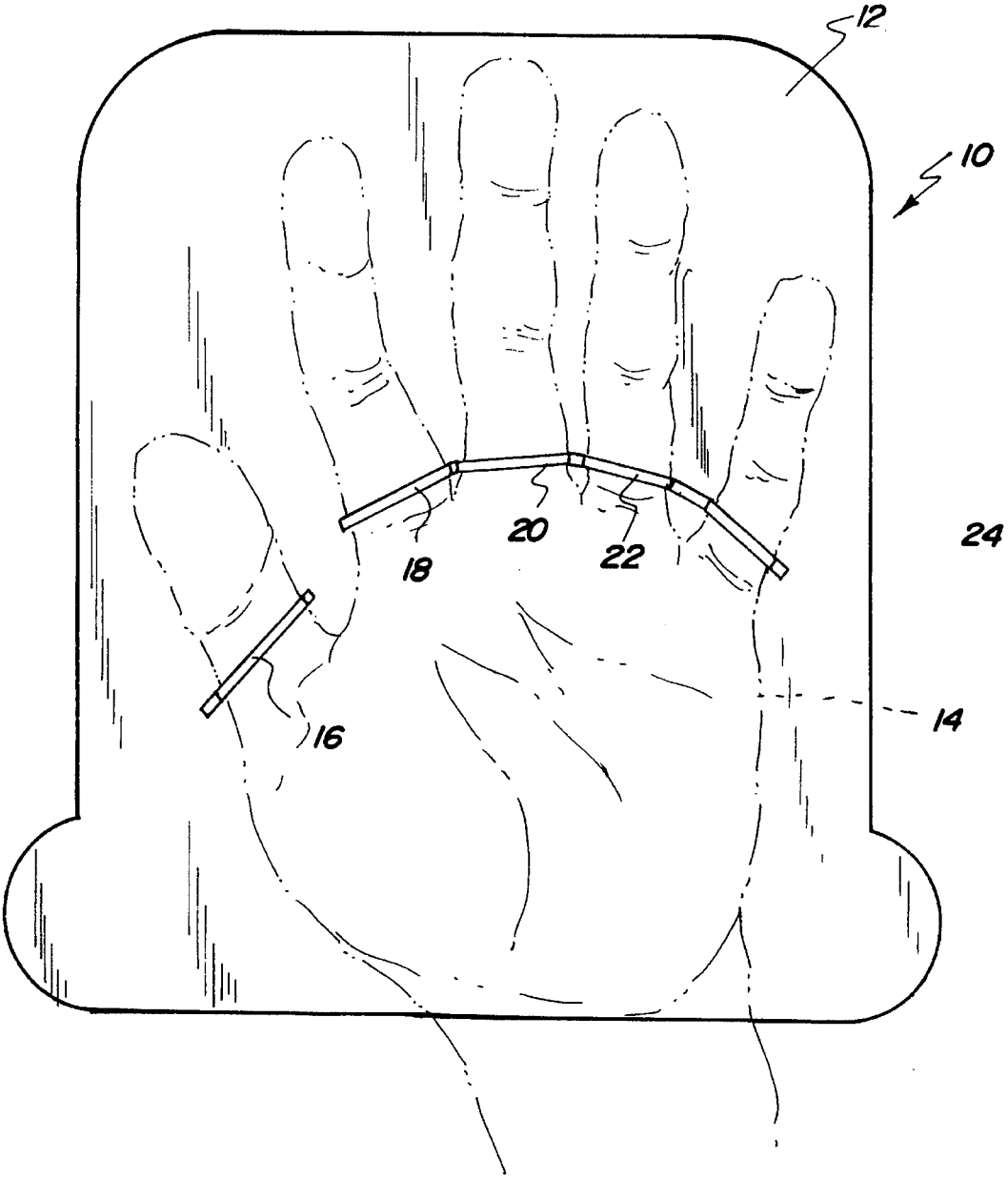
FIG. 1 is an elevation view of a hand shield according to the present invention in use.
Figure 2:
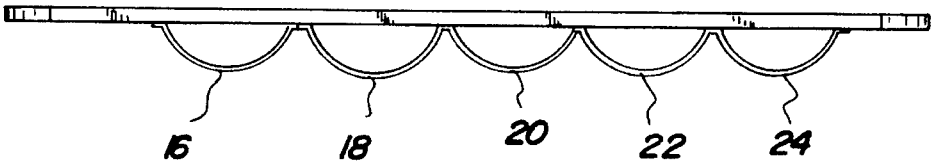
FIG. 2 is an end elevation view thereof.

With reference now to the drawings, and in particular to FIGS. 1–8 thereof, a hand shield embodying the principles and concepts of the present invention and generally designated by the reference numeral 10 will be described.

More specifically, it will be noted that the hand shield 10 comprises a substantially rectangular cover web 12 dimensioned so as to extend over and beyond a back and digits of a human hand 14, as shown in FIG. 1 of the drawings. A plurality of digit loops are secured to a lower surface of the cover web 12 and operate to engage the digits of the human hand 14 so as to couple the device 10 thereto. By this structure, an individual can position the cover web 12 along a back or posterior portion of the human hand 14 so as to block or preclude sunlight from impinging upon the back surface of the hand. The present invention 10 further operates to position the front or anterior portion of the human hand 14 in an unobstructed orientation for use in various activities such as driving or the like.

Figure 3:
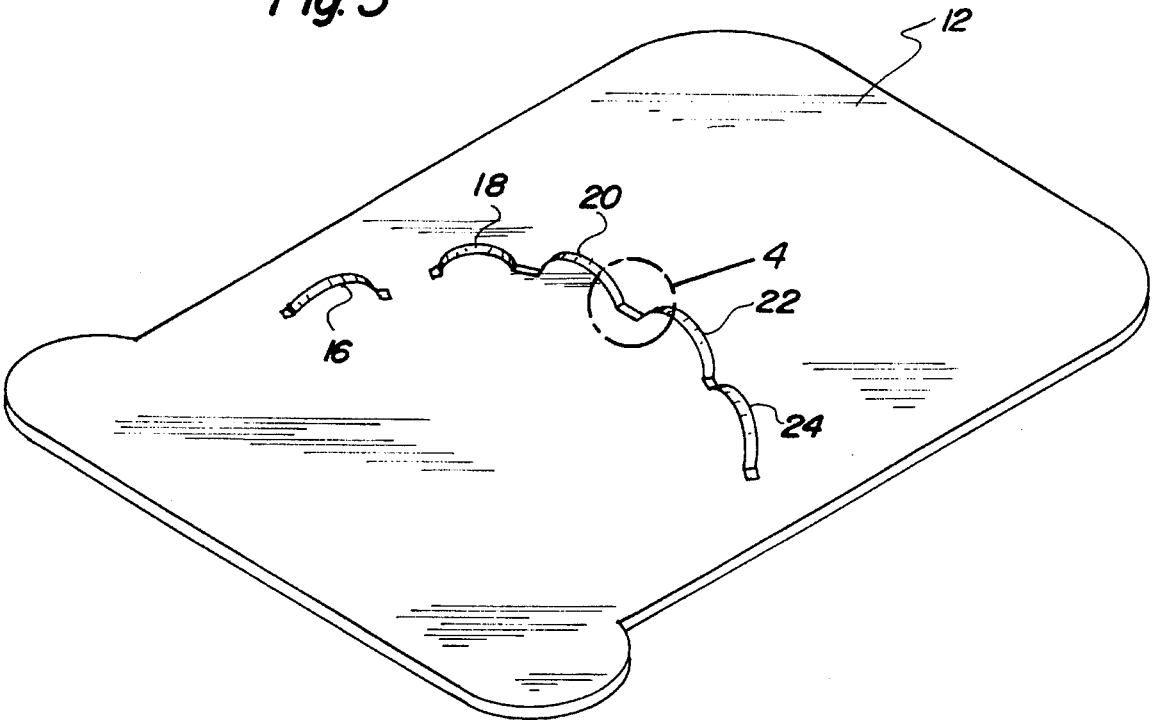
FIG. 3 is an isometric illustration of the invention, per se.
Figure 4:
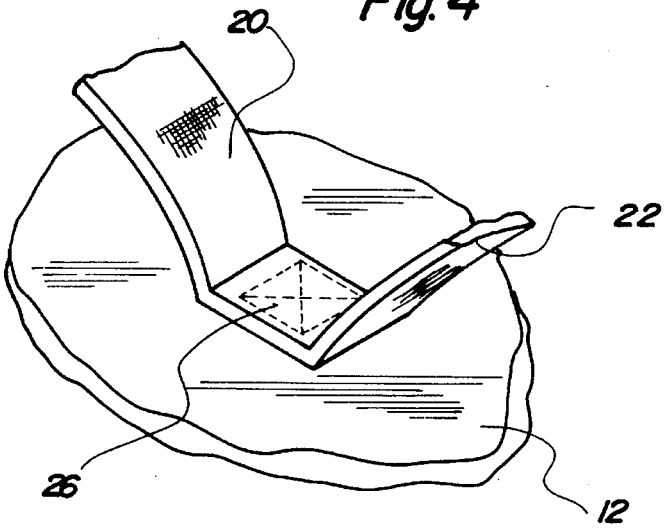
FIG. 4 is an enlarged isometric illustration of the area set forth in FIG. 3.

As best illustrated in FIGS. 1 through 4, it can be shown that the digits loops of the present invention 10 preferably comprise an inner thumb loop 16 coupled to the lower surface of the cover web 12 and positioned for reception of a thumb of a human hand 14 when the device is worn as shown in FIG. 1. A first inner finger inner loop 18 is coupled to the lower surface of the cover web 12 and operates to receive a first finger of the human hand 14. A second inner finger loop 20, a third inner finger loop 22, and a fourth inner finger loop 24 are all similarly coupled to the lower surface of the cover web 12 for receiving the second, third, and fourth fingers of the human hand 14 as shown in FIG. 1 of the drawings. As shown in FIGS. 3 and 4, the finger loops 18–24 are preferably comprised of a single elongated strip which is coupled to the lower surface of the cover web 12 by stitching 26 or like mechanical fastening.

Figure 5:
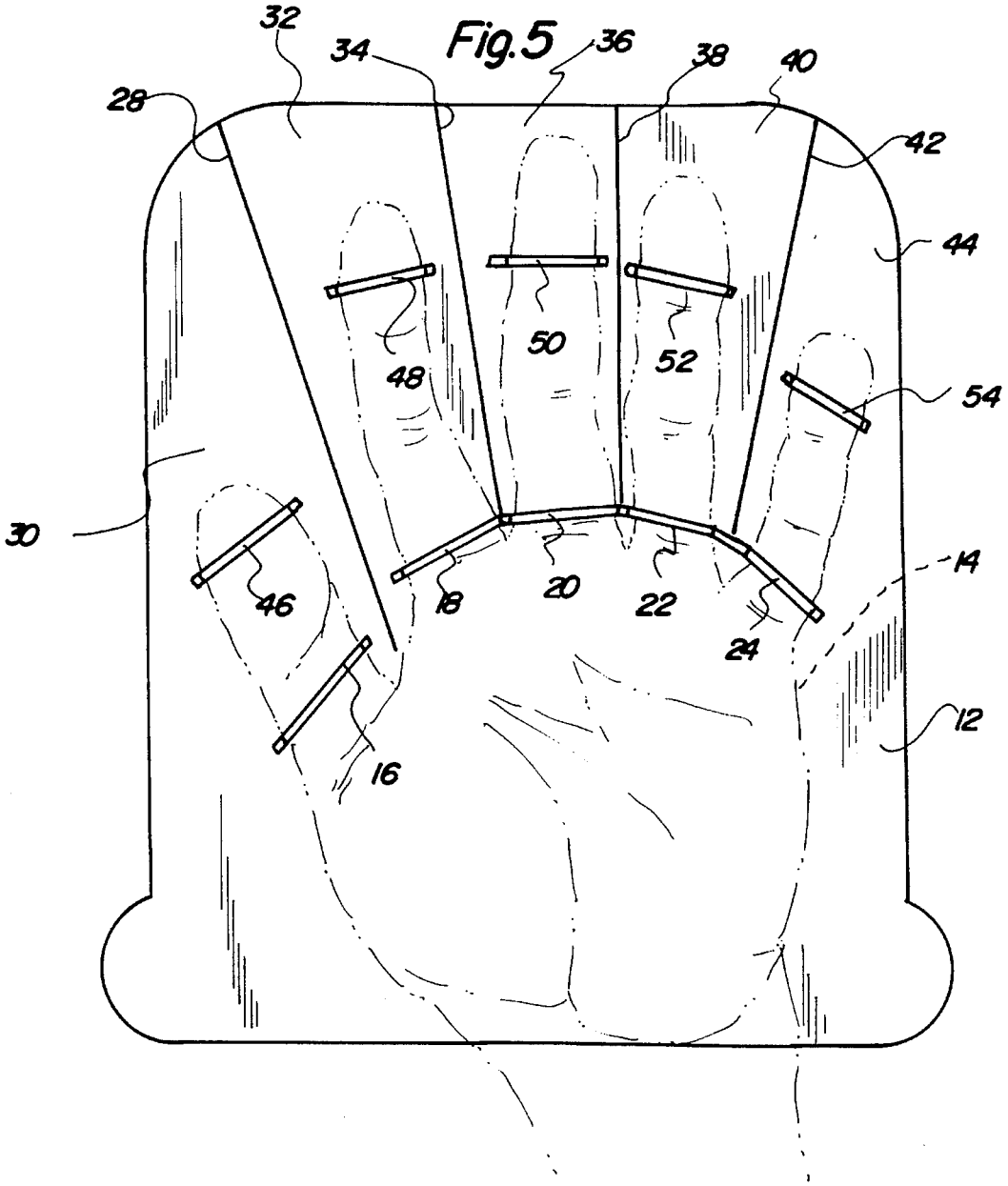
FIG. 5 is an elevation view of an alternative form of the present invention.
Figure 6:
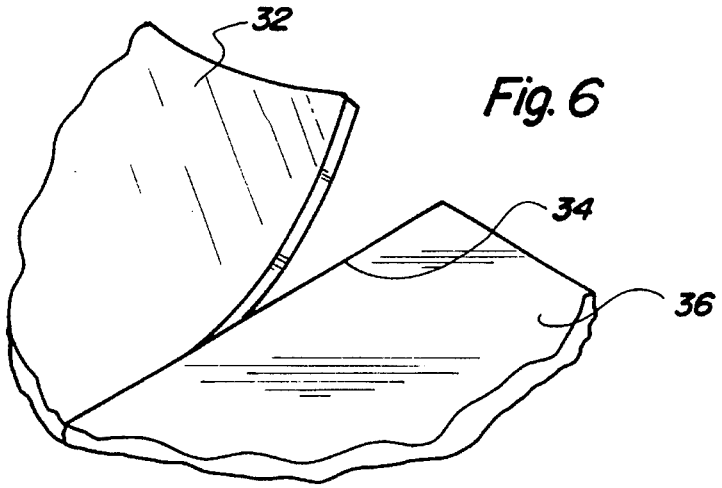
FIG. 6 is an enlarged isometric illustration of a portion of the alternative form of the invention.

Referring now to FIGS. 5 and 6, it can be shown that the cover web 12 may be shaped so as to define a plurality of slits directed therethrough enabling an individual to individually articulate the digits of the human hand 14 when the device is positioned therein as shown in FIG. 5. To this end, a first slit 28 is directed into the cover web 12 and between the thumb loop 16 and the first inner finger loop 18 so as to define a thumb web 30 extending over a posterior surface of a thumb of the human hand 14 and a first web 32 extending over a posterior surface of the first finger of the hand. Similarly, a second slit 34 is directed through the cover web 12 and between the first inner finger loop 18 and the second inner finger loop 20 so as to define a second web 36 extending over a posterior portion of the second finger of the human hand 14 when the device is worn. A third slit 38 is directed into the cover web 12 and between the second inner finger loop 20 and the third inner finger loop 22 so as to define a third web 40 positionable over a posterior portion of a third finger of the human hand 14. Lastly, a fourth slit 42 is directed into the cover web 12 and extends between the third inner finger loop 22 and the fourth inner finger loop 24 so as to define a fourth web 44 positionable over the posterior portion of a fourth finger of the human hand 14. As shown in FIG. 5, the slits each extend radially outwardly.

To further couple the separated webs 30, 32, 36, 40, and 44 to the respective digits of the human hand 14, the alternative form of the present invention 10 illustrated in FIG. 5 further comprises an outer thumb loop 46 coupled to the lower surface of the thumb web 30 and positioned for reception of an outer distal portion of the thumb of the human hand 14. A first outer finger loop 48 is coupled to a lower surface of the first web 32 and operates to receive an outer portion of the first finger of the human hand 14. Similarly, a second outer finger loop 50, a third outer finger loop 52, and a fourth outer finger loop 54 are coupled to the lower surfaces of the respective second, third, and fourth webs 36, 40, and 44 and each operate to receive an outer distal portion of the respective second, third, and fourth fingers of the human hand 14. By this structure, individual articulation of the digits of the human hand 14 can be accomplished while simultaneously ensuring that the webs 30, 32, 36, 40, and 44 of the cover web 12 remain proximal to the respective digits of the human hand 14. As shown in FIG. 5, the adjacent webs abut each other with an inner width less than an outer width.

Figure 7:
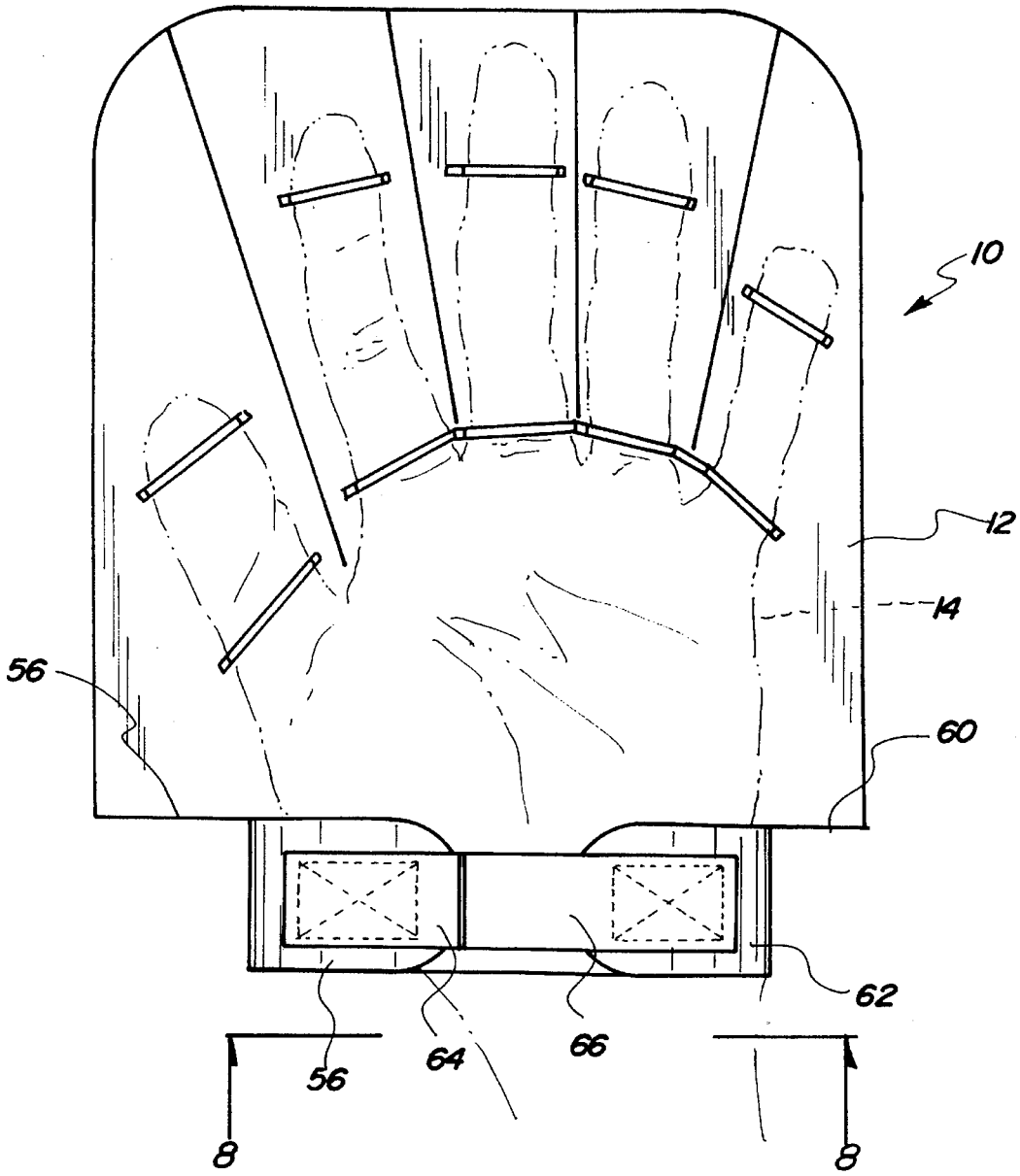
FIG. 7 is an elevation view of a further alterative form of the present invention.
Figure 8:
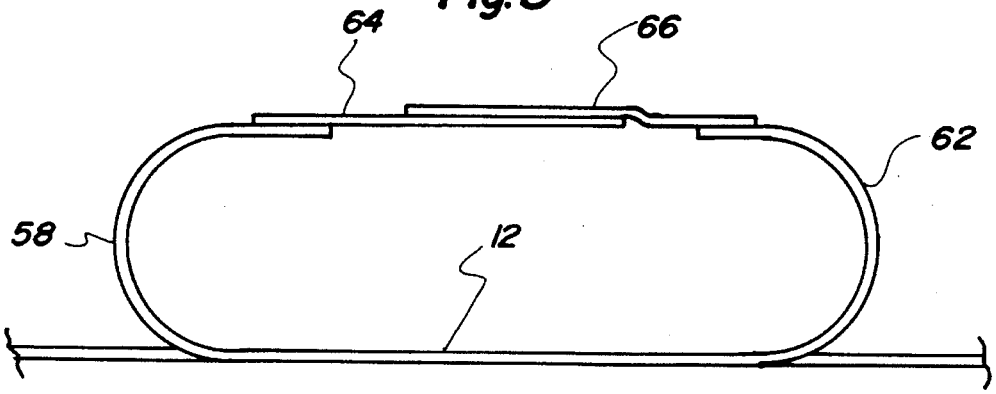
FIG. 8 is an end elevation view of a portion of the present invention taken from line 8—8 of FIG. 7.

Referring now to FIG. 7, it can be shown that the present invention 10 may further comprise a wrist strap assembly for extending about a wrist of the human hand 14. To this end, the cover web 12 is shaped so as to define a first wrist slit 56 directed thereinto defining a first wrist strap 58 which can be positioned about a portion of a circumference of a human wrist. Similarly, a second wrist strap 60 is directed into the cover web 12 so as to define a second wrist strap 62 positionable about a further portion of a circumference of the human wrist. A first hook and loop patch 64 is secured to the first wrist strap 58, with a second hook and loop patch 66 being secured to the second wrist strap 62. The hook and loop patches 64 and 66 can be cooperatively engaged as shown in FIG. 8 so as to circumferentially extend about a human wrist of the human hand 14 to ensure proximal positioning of the cover web 12 to the posterior or back of the human hand 14 during use of the device 10.

In use, the hand shield 10 according to the present invention can be easily utilized for covering a posterior portion of a human hand 14 while leaving an anterior or palm portion thereof exposed for use in various activities. The alternative form of the invention illustrated in FIGS. 5 and 6 permits an individual to individually articulate the digits of the human hand 14 during various tasks. The wrist strap illustrated in FIGS. 7 and 8 operates to preclude pivoting of the cover web 12 from the posterior or back portion of the human hand 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hand shield comprising:

a substantially rectangular cover web dimensioned so as to extend over and beyond a back and digits of a human hand, the cover web shaped so as to define a plurality of finger slits directed therethrough enabling an individual to individually articulate the digits of the human hand when the shield is worn;

plurality of digit loops secured to a lower surface of the cover web and being adapted to engage digits of a human hand, the digit loops comprise an inner thumb loop coupled to the lower surface of the cover web and positioned for reception of a thumb of a human hand; a first inner finger inner loop coupled to the lower surface of the cover web and positioned for reception of a first finger of the human hand; a second inner finger inner loop coupled to the lower surface of the cover web and positioned for reception of a second finger of the human hand; a third inner finger inner loop coupled to the lower surface of the cover web and positioned for reception of a third finger of the human hand; a fourth inner finger inner loop coupled to the lower surface of the cover web and positioned for reception of a fourth finger of the human hand; an outer thumb loop coupled to the lower surface of the cover web and positioned for reception of an outer distal portion of a thumb of a human hand; a first outer finger loop coupled to a lower surface of the cover web and positioned for reception of an outer portion of a first finger of a human hand; a second outer finger loop coupled to a lower surface of the cover web and positioned for reception of an outer portion of a second finger of a human hand; a third outer finger loop coupled to a lower surface of the cover web and positioned for reception of an outer portion of a third finger of a human hand; and a fourth outer finger loop coupled to a lower surface of the cover web and positioned for reception of an outer portion of a fourth finger of a human hand;

the finger slits including a first finger slit directed into the cover web and between the thumb loop and the first inner finger loop so as to define a thumb web positionable over a posterior surface of a thumb of a human hand and a first web positionable over a posterior surface of a first finger of a hand; a second finger slit directed into the cover web and between the first inner finger loop and the second inner finger loop so as to define a second web positionable over a posterior portion of a second finger of a human hand; a third finger slit directed into the cover web and between the second inner finger loop and the third inner finger loop so as to define a third web positionable over a posterior portion of a third finger of a human hand; and a fourth finger slit directed into the cover web and extending between the third inner finger loop and the fourth inner finger loop so as to define a fourth web positionable over a posterior portion of a fourth finger of a human hand, wherein the cover web is shaped so as to define a first wrist slit directed thereinto defining a first wrist strap positioned for extension about a portion of a circumference of a human wrist; and a second wrist slit directed thereinto defining a second wrist strap positioned for extension about a portion of a circumference of a human wrist; and further comprising a first hook and loop patch secured to the first wrist strap, and a second hook and loop patch being secured to the second wrist strap, wherein the hook and loop patches can be cooperatively engaged to secure the straps circumferentially about a human wrist of a human hand and the finger webs abut each other with an inner width less than an outer width.

* * * * *